US005560604A

United States Patent [19]

Watts

[11] Patent Number: 5,560,604

[45] Date of Patent: Oct. 1, 1996

[54] GOLF SWING AID

[76] Inventor: Kenneth E. G. Watts, 34 Clonrowan Rd., Woodville South 5011, Australia

[21] Appl. No.: 514,090

[22] Filed: Aug. 11, 1995

[30] Foreign Application Priority Data

Aug. 19, 1994 [AU] Australia ..... 70336/94
Jun. 14, 1995 [GB] United Kingdom ..... 9512097

[51] Int. Cl.[6] ..... A63B 69/36

[52] U.S. Cl. ..... 273/147; 273/58 C

[58] Field of Search ..... 273/200 R, 200 A, 273/200 B, 58 C; 473/147, 139, 140, 141, 142, 143, 144

[56] References Cited

U.S. PATENT DOCUMENTS 795,960 8/1905 Cook ..... 273/58 C
1,473,954 11/1923 Easton ..... 273/200 R X

FOREIGN PATENT DOCUMENTS 352244 7/1931 United Kingdom ..... 273/200 R
444646 3/1936 United Kingdom ..... 273/200 R

*Primary Examiner*—George J. Marlo
*Attorney, Agent, or Firm*—Richard C. Litman

[57] ABSTRACT

A golf swing aid apparatus comprising: a pair of posts having holes proximate to their upper ends said pair of posts being transversely spaced and adapted to be secured to a ground surface;

a relatively short extensible elastomeric shock cord joined at its ends to the upper ends of respective said pair of posts, at said holes, said shock cord held taut by an adjustable tension means comprising eye bolts which extend transversely in line with the shock cord from the respective holes in the posts, and adjustment means to adjust the extent to which the eye bolts extend from said posts to adjust the tension in said shock cord;

a ring having a control opening substantially larger than the diameter of the shock cord and surrounding the shock cord to be freely slidable along it;

a golf ball having an aperture extending through it; and an inextensible cord of relatively greater length than said elastomeric shock cord, said inextensible cord having a loop at each end, wherein one said loop passes through said golf ball aperture and the other said loop passes through said ring; whereby a golfer can identify and correct a slicing or hooking stroke and retrieve the golf ball without a hazardous return.

9 Claims, 3 Drawing Sheets

GOLF SWING AID

BACKGROUND OF THE INVENTION

1. Field of the Invention

This invention relates to an aid to assist a person in developing a golf swing, the aid being of the type wherein a ball is tethered.

2. Description of the Prior Art

Tethered golf balls are well known and are in common use, but usually they are associated with an elastomeric cord of some type so that the golf ball will be at least partly returned to the golfer after having been struck. Unfortunately however, the golf ball when struck with merely an elastomeric cord and a peg in the ground will return high in the air and sometimes with sufficient force to actually constitute a hazard to a golfer.

The alternative in using an inextensible cord has also been proposed, but that of course fails to return the ball to the golfer.

The difficulty has been recognised and reference may be made to Australian Patent No. 540409 in the names of PRETORIUS and BATH, wherein inextensible "filaments" were used, one long filament extending between spaced apart posts and being stretched and the other short filament being slidable along the long filament and having the ball attached to it. The resilience of the entire structure was relied upon for rapid return of the ball, but that arrangement is possibly unsuitable for golfing, in that the ball is normally suspended from the long filament. This is however used to hit the ball along the inextensible string rather than transverse to it.

There are several other suggestions whereby a ball is supported on a string supported from a further string extended between two posts. Examples of these can be found in U.S. Pat. Nos. 5,386,989 by Broadway, 4,216,960 by Nichols, 3,658,330 by Maestracci et al, 2,772,882 by Anson, and 1,708,796 by Lawrence. These however all include the use of extensible elastomeric cords connecting to the ball, or use no extensible elastomeric cords at all.

SUMMARY OF THE INVENTION

In contrast to the above prior art (the closest known to the Applicant), in this invention use is made of an extensible elastomeric shock cord extending between two posts transversely, having a ring surrounding the shock cord to be freely slidable, and a relatively long but inextensible cord extends between that ring and a golf ball.

With this arrangement it is possible to have the golf ball returned approximately to the golfer but after having first encountered the ground and thereby having lost most of its momentum. The hazard can be very substantially reduced.

More specifically, the invention is defined as a golf swing aid comprising a pair of posts which, in use, are transversely spaced and inserted in the ground, a relatively short elastomeric shock cord having a control opening substantially larger than the diameter of the shock cord joined at its ends to the upper ends of the respective posts, a ring surrounding and freely slidable along the shock cord, a golf ball having an aperture extending through it, and a relatively inextensible cord of greater length than the elastomeric shock cord having a loop at each end, one loop passing through the golf ball aperture and the other passing through the ring.

It is of course desirable that the elastomeric shock cord should be at least taut if not stretched between the posts, and the ends of the shock cord can be secured to the posts through the upper ends of the posts, the securing being by any means but preferably by means of knots.

Still further, the loops in the ends of the inextensible cord can also be formed by splices.

BRIEF DESCRIPTION OF THE DRAWINGS

An embodiment of the invention is described hereunder in some detail with reference to and is illustrated in the accompanying drawings in which.

DETAILED DESCRIPTION OF THE PREFERRED

Figure 1:
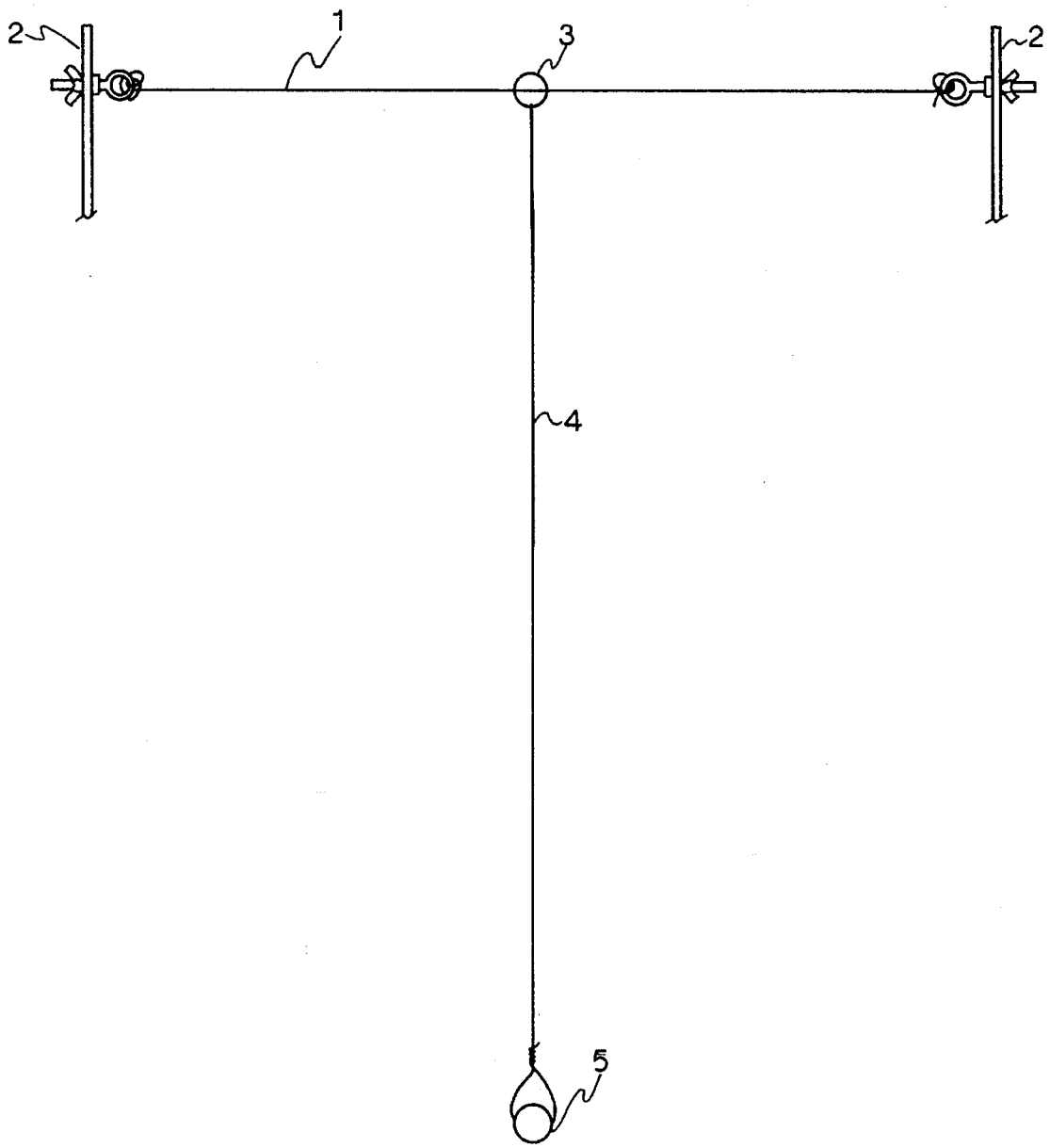
FIG. 1 is a plan view showing the golf swing aid assembly as it would be positioned in use.

In this embodiment, an elastomeric shock cord 1 extends between two upstanding posts 2 and is attached thereto by means of eye bolts passing through holes or throughbores 11.

A ring 3 is freely slidable over the shock cord 1, and a relatively inextensible cord, for example, a three strand rope, designated 4, has a loop at each end, one end loop being joined to the ring 3 and the other to a golf ball 5.

Figure 2:
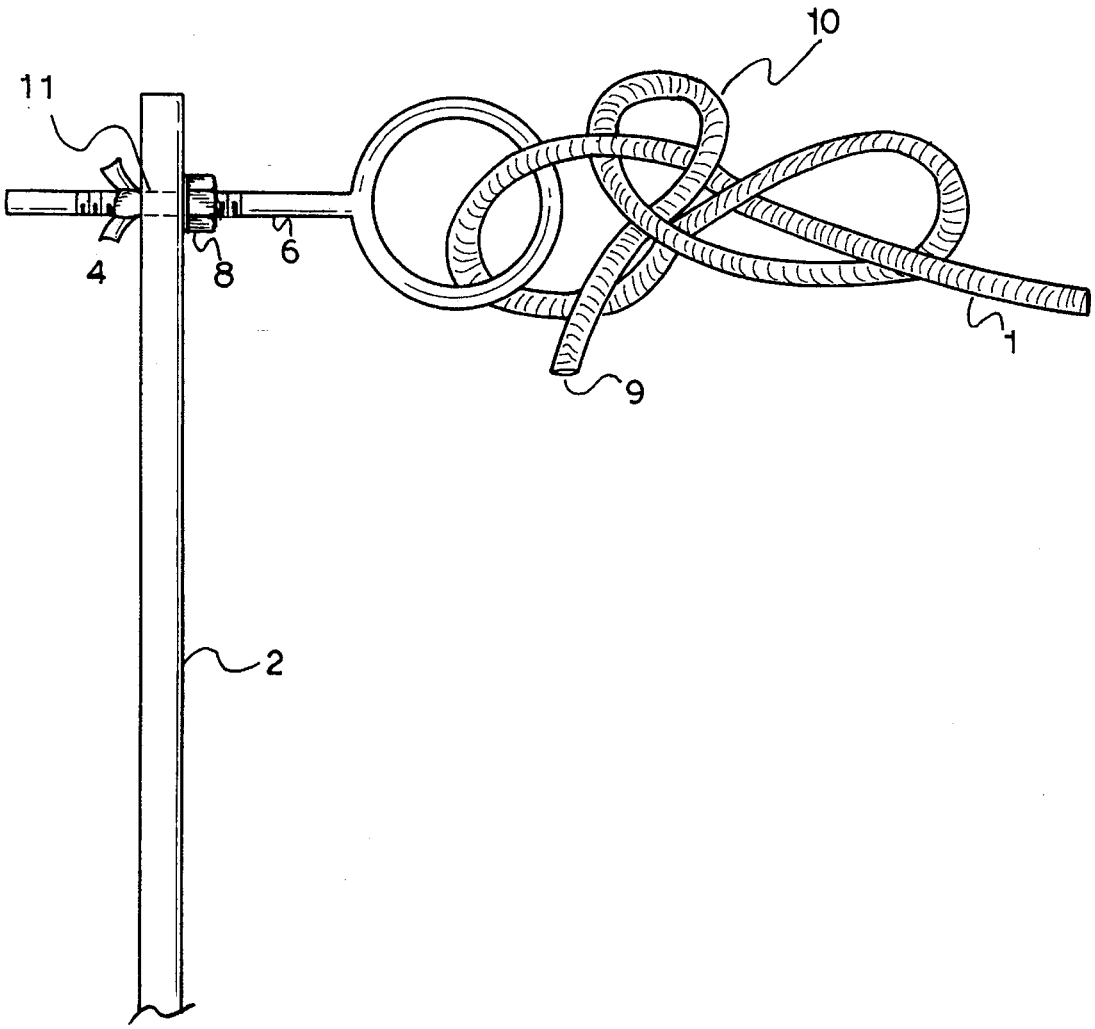
FIG. 2 is a partial side view of the left post in FIG. 1 and shows the joint between an end of a shock cord and an eye bolt.

Referring now to FIG. 2, the shock cord 1 passes through the loop of an eye bolt 6, which is adjustable by means of a wing nut 7 co-operating with a locking nut 8 and the end 9 of the shock cord in passing through the loop is returned to provide a bowline knot 10 to join the shock cord end to the eye bolt 6.

Figure 3:
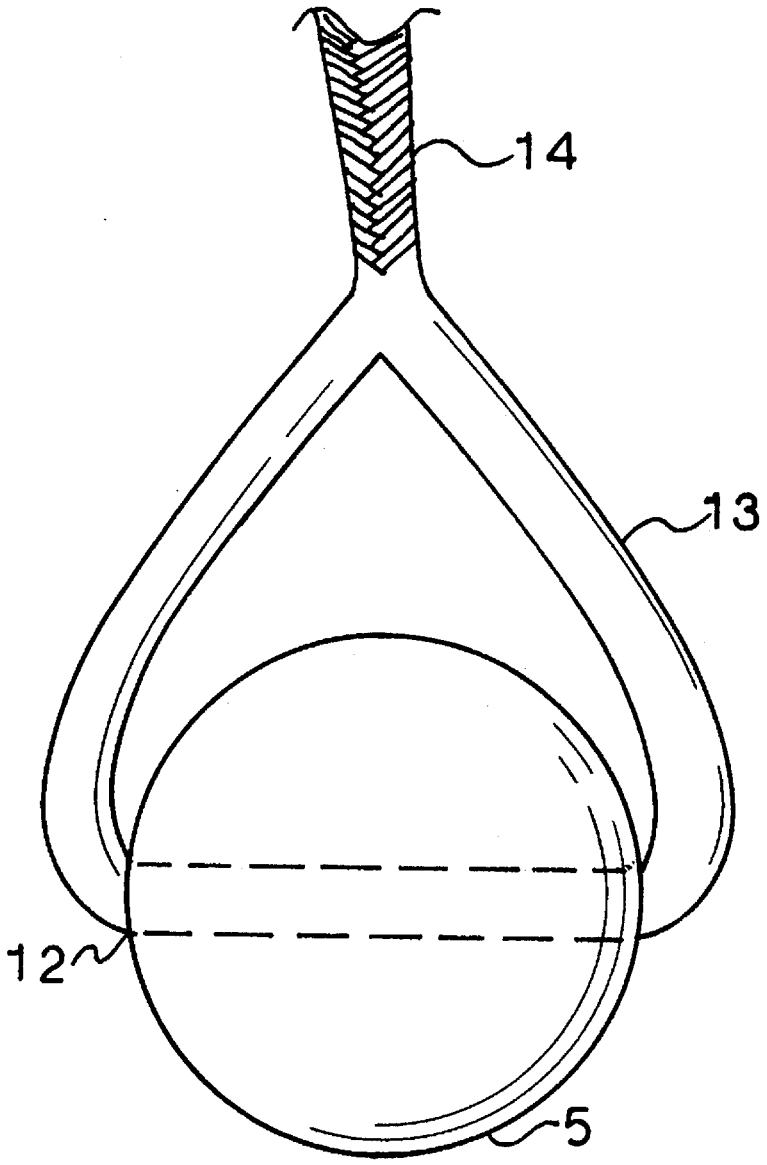
FIG. 3 is a partial plan view of the golf ball attachment and shows the loop of the inextensible cord passing through an aperture in a golf ball depicted by dashed lines.

Each end of the inextensible cord 4 forms a respective loop, and FIG. 3 shows the way in which that is achieved. In FIG. 3, the golf ball 5 has an aperture or hole 12 extending through it, either centrally as shown, or a little to one side of the central axis, the loop 13 being again joined to the inextensible cord 4 by a knot 14 which, in this embodiment, is the splice of an "eye splice".

When the golf ball 5 is struck by a club, it would normally rise over the top of the shock cord 1, and would extend the shock cord which would have the effect of slowly reducing its velocity as more energy is transferred to be absorbed by the resilience of the shock cord, and would then be returned, but with this arrangement, the return of the ball would usually result in the ball striking the ground before it is returned approximately to the position of the golfer.

There are further advantages in this invention which do not exist in other practice devices known, one of them being that the existence of a slice or hook in the stroke of the club is relatively easily identified by the golfer and can be corrected. Secondly, in having the aperture or hole 12 extending through the golf ball 5, distortion of the golf ball does not cause rapid deterioration of the ball to such an extent as with those devices which have a single cord extending from one opening only in the ball. If instead of having the aperture or hole 12 diametral, it is moved a little to one side so as to provide a greater portion of the ball confronting the club, the life of the ball can be further extended. In any case, however, the components of the invention are so inexpensive that this is not a matter of great importance.

The claims defining the invention are as follows:

1. A golf swing aid apparatus comprising:

a pair of posts having holes proximate to their upper ends, said pair of posts being transversely spaced and adapted to be secured to a ground surface;

a relatively short extensible elastomeric shock cord joined at its ends to the upper ends of respective said pair of posts, at said holes, said shock cord held taut by an adjustable tension means comprising eye bolts which extend transversely in line with the shock cord from the respective holes in the posts, and adjustment means to adjust the extent to which the eye bolts extend from said posts to adjust the tension in said shock cord;

a ring having a control opening substantially larger than the diameter of the shock cord and surrounding the shock cord to be freely slidable along it;

a golf ball having an aperture extending through it; and an inextensible cord of relatively greater length than said elastomeric shock cord, said inextensible cord having a loop at each end, wherein one said loop passes through said golf ball aperture and the other said loop passes through said ring; whereby a golfer can identify and correct a slicing or hooking stroke and retrieve the golf ball without a hazardous return.

2. The golf swing aid apparatus according to claim 1, wherein the pair of posts are short, so that on striking the golf ball, said golf ball is hit over the shock cord.

3. The golf swing aid apparatus according to claim 1, wherein the aperture in the golf ball is transverse to the direction in which the ball is to be hit.

4. The golf swing aid apparatus according to claim 3, wherein the aperture extends a distance less than the diameter of the golf ball.

5. The golf swing aid apparatus according to claim 3 wherein the aperture extends through a central axis of the golf ball.

6. A golf swing aid as in claim 1 wherein the loops in the ends of the inextensible cord are formed by splicing.

7. The golf swing aid apparatus according to claim 1, wherein each said loop of said inextensible cord comprises a spliced loop.

8. The golf swing aid apparatus according to claim 1, wherein said shock cord ends are tied to the adjustable tension means of the respective pair of posts by bowline knots.

9. The golf swing aid apparatus according to claim 1, wherein said eye bolts are adjustable transversely by a wing nut cooperating with a locking nut.

* * * * *